United States Patent [19]

Casutt

[11] 4,387,549

[45] Jun. 14, 1983

[54] METHOD OF MANUFACTURING A PACK FOR OVOIDAL OBJECTS

[76] Inventor: Toni Casutt, Blumenrain 24, CH-8702 Zollikon, Switzerland

[21] Appl. No.: 251,732

[22] Filed: Apr. 7, 1981

[30] Foreign Application Priority Data

Apr. 9, 1980 [CH] Switzerland ..... 2714/80

[51] Int. Cl.[3] ..... B65B 43/08

[52] U.S. Cl. ..... 53/456; 493/92; 493/334; 493/344; 493/356; 493/913

[58] Field of Search ..... 493/92, 913, 90, 346-343, 493/357, 356, 391, 333-335; 53/456, 568, 158, 208

[56] References Cited

U.S. PATENT DOCUMENTS

| | | | |
|---|---|---|---|
| 2,195,916 | 4/1940 | Brown et al. | 493/913 X |
| 2,741,417 | 4/1956 | Rossum | 493/391 X |
| 2,803,933 | 8/1957 | Patin | 493/391 X |
| 2,975,683 | 3/1961 | Lehner-Stirnemann | 493/913 X |
| 3,055,152 | 9/1962 | Williams | 493/72 X |
| 3,238,693 | 3/1966 | Burt | 493/356 X |
| 3,362,609 | 1/1968 | Freedy | 493/356 X |
| 3,983,680 | 10/1976 | Casutt | 53/29 |

*Primary Examiner*—James F. Coan

*Attorney, Agent, or Firm*—Frishauf, Holtz, Goodman & Woodward

[57] ABSTRACT

A cardboard pack for eggs, or the like, is made of two slitted blanks, the longer one of which is bent into flat-topped and flat-bottomed waves. After the wave bottoms are bonded by adhesive to the flat blank, the wave tops are tucked in and the waves flattened mechanically. After the adhesive bonding, the solid cross-strips at the ends of the flat blanks become unnecessary and are cut off. Precautions are taken to avoid undesired adhesion of strips previously separated by slitting. With the waves flattened, the blanks can be easily stored or transported. The blanks are set up at the place of filling by mechanically raising the waves, bending up the sides of the back to form pockets, inserting the goods, bending over the top strips, and securing them together on their line of abutment. The shorter set of blanks is preprinted.

2 Claims, 10 Drawing Figures

METHOD OF MANUFACTURING A PACK FOR OVOIDAL OBJECTS

The invention concerns a method for manufacture of a pack suitable for packing eggs and other fragile objects of more or less ovoidal shape. An embodiment type of the pack itself to which the present invention relates is already described in U.S. Pat. No. 3,983,680. The method and manufacture there described proceeded on the basis of a continuous process in which a cardboard strip drawn from a supply roll was given a corrugated form providing transverse waves, followed by pulling this wavy strip along together with a flat cardboard strip from another roll and bonding the flat and wavy bands of cardboard together, then slitting the resulting structure, setting up the pack strip by folding it up on lengthwise corner edges, filling the packs and only thereafter cutting the structure apart into separate pack units.

In the provision of this type of packs, however, there is the need to provide printing on the external surface of the pack. The printing from rollers can be carried out only in the flat condition, before the connection with the wavy structure to the flat portion. This again brings the disadvantage that in cutting apart the completed packing, the errors add up and finally the printing no longer registers with the subdivision of the cardboard into packing units, because of the unavoidable length tolerances of the process. Furthermore, such a production line is very long, which makes difficult or even impossible setting up such a manufacturing line in existing buildings.

It has furthermore been found desirable to manufacture the packs in a central cardboard boxing operation and thereafter to distribute the packs in empty condition to the actual egg-packing stations which are scattered around in various country locations.

The Invention

It is an object of the present invention to provide a method of manufacturing packs for ovoid objects of the general kind mentioned above, in which in a first business location fully ready, printed, empty and non-tangling packs are produced that are then set up and filled in a second, usually remote, business location.

Briefly, this object is fulfilled by the steps of stamping a first flat cardboard blank into five lengthwise-running strips, by cutting four parallel slits, leaving the strips connected together at each end by cross strips, and also preparing a second and longer cardboard blank by slitting it intermittently along four parallel lengthwise-running lines and also providing cross-bending preparations, such as scoring lines or the like, then forming flat-topped corrugations or waves along the bending lines of the second blank and adhesively bonding the bottoms of the waves to the flat blanks, then lapping over the waves by tucking in the flat top to provide a scale-like structure, separating some bonded places along the already separated lengthwise strips of the first blank and, at some stage, cutting off end cross strips of at least the first blank.

In this way, it is possible to rationalize considerably the manufacture of such packs, with avoidance of large space requirements for machines. Furthermore, the speed of manufacturing the packs does not need to be fitted to the speed with which the packs can be filled with eggs. The empty packs have only a small space requirement and can be distributed to the packing locations, which can be relatively far away, with little transport expense and difficulty.

The remaining steps performed at the packing location are basically simple, which is to say that the packs as delivered to the location are ready to be set up without trouble. The remaining steps involve setting up the wave structure from the lapped-over to the upright form, bending up the side portions of the pack with formation of upwardly open pockets, filling the objects to be packed in the pockets, bending over the upper pack portions and securing them, as by sealing with tape, along the abutment edge of the upper portions.

The invention is described in detail by way of illustrative example with reference to the annexed diagrams of diagrammatically showing the results of the various steps of manufacture according to the inventions.

DESCRIPTION OF THE METHOD AS ILLUSTRATED

Figure 1:
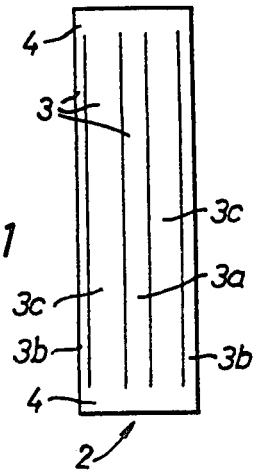
FIG. 1 is a plan view of a first cardboard blank.

Flat cardboard sheets or cardboard strips are printed with desired slogans and inscriptions and thereafter first blanks 2 as shown in FIG. 1, thus in the form of oblong or strip-shaped rectangular blanks, are cut out of the sheets or strips. These blanks 2 later provide the external surfaces of the packs. They have five mutuallly parallel lengthwise running strips 3 that are separated from each other along their length (by four slits) and remain connected only by the cross-strips 4 respectively provided at the two ends.

The center strip 3*a* is twice as wide as the two external strips 3*b*. The two lengthwise strips 3*c* inbetween the strips already named are each wider than the middle strip 3*a*.

Figure 2:
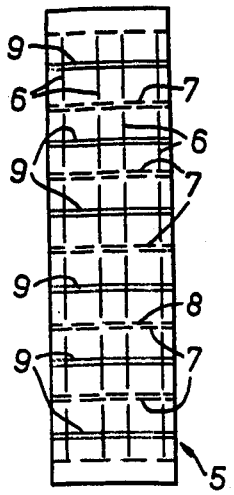
FIG. 2 is a plan view of a second cardboard blank from which the wavy strip will later be shaped.

From another roll of cardboard, or from another large flat sheet, second cardboard blanks 5 according to FIG. 2 these then being rectangular strips. At the same time or in an immediately following work operation, these blanks are cut to form interrupted slits 6 running in the lengthwise direction. These lie on four mutually parallel lines extending in the lengthwise direction. They are interrupted by transverse strips 7 which later form the wave crests, which are bounded by bending lines that are scored, perforated, or otherwise weakened so that the bending can proceed more easily. The perforations 8 thus in each case form a double line with a mutual spacing of preferably 6 mm. Between every two wave crests is a wave bottom strip 9 that is bounded by bending scores 10 or perforations. Each of these wave-bottom-forming strips will later be bonded with adhesive to the first blank 2.

Figure 3:
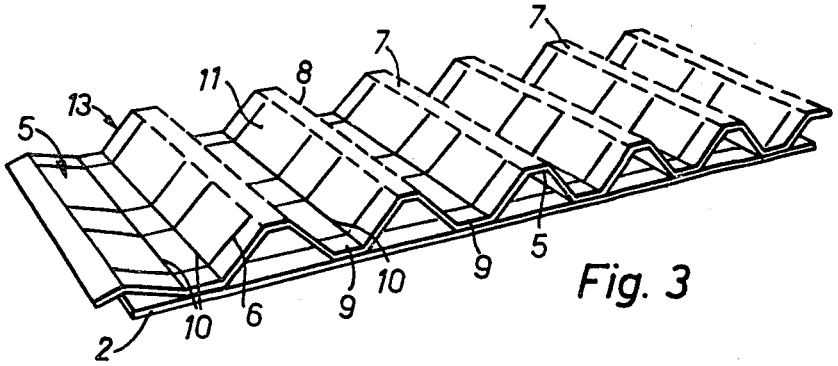
FIG. 3 is a perspective view of the pack after the first cardboard blank is bonded to the waved or corrugated strip.

In the second blank 5, waves or corrugations 13 are successivly formed by shaping tools with the result shown in FIG. 3, where alternately the unslit cross-strips 7 form the wave crests and the parts 9 the wave valleys or bottoms and, thus, run perpendicular to the longitudinal dimension of the blank 5. The blank 5, which is the flat condition is substantially longer than the first blank 2, is shortened by the formation narrowly is flat-topped and flat-bottomed waves.

Next follows the adhesive bonding of the first flat blank 2 with the now wavy-shaped blank 5. For this purpose adhesive stripes are laid transversely on the first blank 2, in each case at the location for a wave bottom strip 9 of the other blank 5, so that the wave-shaped blank 5 laid on the blank 2 will be adhesively bonded by its wave bottom strips 9, as shown in FIG. 3.

Figure 4:
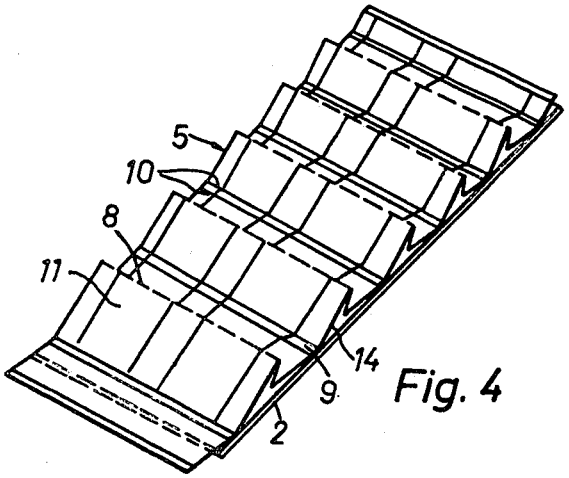
FIG. 4 is a perspective view of the pack of FIG. 3 with the waves about to be fully flattened by lapping over.
Figure 5:
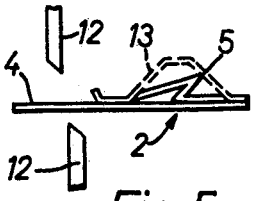
FIG. 5 is a schematic representation, in end view, of the cutting operation for cutting off the cross strips at the ends of the first cardboard blank.

For saving of shipping space, the waves are lapped over, or collapsed, by tucking in the top strips 7 to form a succession of scales or flakes as shown in FIG. 4. In order that the scales should lie as flat as possible, appropriate dimensional relations should be provided for the waves. The doubled length of the oblique surfaces 11 of the wave less the width of the strips 7 forming the wave summits, should correspond to the spacing between the bending boundaries of successive wave bottoms in order to allow the scale structure to lie as flat as possible (flatter than shown in FIGS. 4 and 5 for purposes of illustrating the tucking process).

The perforations 8 facilitate the shaping of the waves. The laying flat of the waves is produced by a mechanical finger exerting a downwardly oblique motion on one edge of each wave summit so as to tap the summit under one of the adjacent waves 5, so that all of the waves will be tucked in simultaneously by an array of mechanical fingers.

Figure 10:
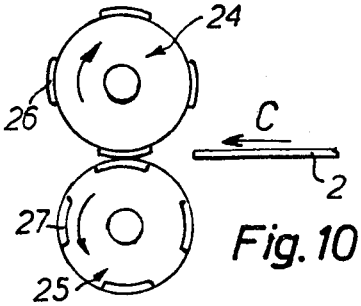
FIG. 10 is a schematic representation of the device for breaking apart undesired adhesions.

In application of the adhesive to the first blank 2 with gumming wheels, an undesired sticking together of the lengthwise running strips 3, cross-ways to the longitudinal direction of the blank, can take place. In order that these bondings should not interfere with the later setting up of the pack, these undesired bonding places are broken between the lengthwise strips *3a, 3b, 3c*. This is done in such a way that the pack is either bowed lightly perpendicular to its longitudinal direction, whereby the individual gumming places between the longitudinal strip will break up or, as shown in FIG. 10, the pack can be led between rollers 24 and 25 provided with step projections 26 and corresponding cavities 27, so that when the pack is fed between the rollers transversely to its length dimension in the direction of the arrow C of FIG. 10, the consequence is a breaking up of the undesired adhesions.

Since the end cross strips 4 of the blanks 2 are no longer necessary, they are cut off at both ends in order to make possible the later setting up of the pack. This is done with shearing tools 12, such are diagrammatically represented in FIG. 5.

At this stage the "scaled" flat packs can further be pressed between two rotatable rollers in order to bring them into the flattest possible condition for minimum space requirements.

The empty packs thus manufactured can then be stored or transported to remote locations of packing installations. Here the waves 13 are again erected by mechanical fingers and thereafter the two lateral pack portions 20 are bent up around bending edges 14, each by 90°, so that there results a structure somewhat U-shaped in cross-section, as is evident from FIGS. 6 and 7. Thereafter the objects to be packed in the illustrated case eggs 16 are put in from above in the pocket 15 formed by the wave valleys, the insertion taking place in the direction of the arrow A. Right after that the two upper pack portions 21 are bent around by 90° toward each other in the direction of the arrows B. The bonding in the region of the abutment line 22 can be provided either by adhesive strips 28, drops of glue, or by tabs bent out of the cardboard material folded over and gummed. In the resulting state, the filled pack is ready for sale. Instead of eggs, flower bulbs or the like could be similarly packed.

Figure 6:
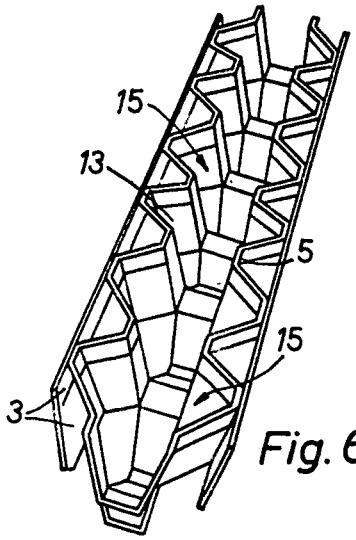
FIG. 6 is a perspective view of the partly set-up pack.
Figure 7:
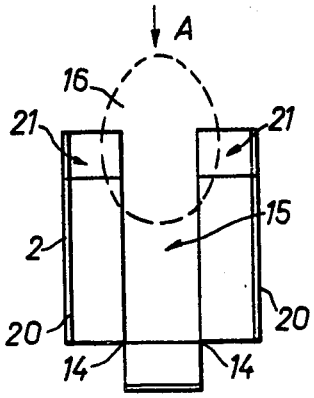
FIG. 7 is a vertical section through the partly set-up pack of FIG. 6.
Figure 8:
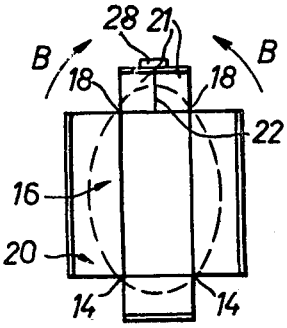
FIG. 8 is a vertical section through the completed pack.
Figure 9:
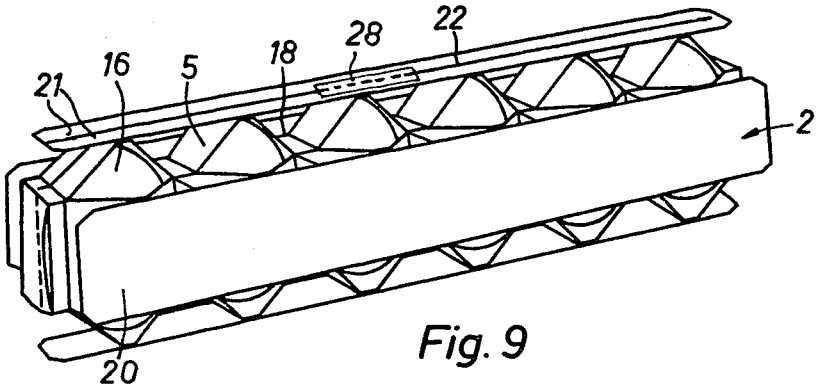
FIG. 9 is a perspective view of a completed pack filled with eggs.

The cross-wise end strips of the blank 5 as shown in FIG. 3, which hold the end portion of the blank together, are actually used when the pack is set up as shown in FIGS. 6 and 9. These end portions of the blank 5 are not shown in FIGS. 4 and 5 in order to simplify those figures.

It is to be understood that the steps which the method of the invention comprises do not necessarily follow each other in the order description given above or the order of listing in claim 1. In particular, the cutting off of the cross-strips take space before the lapping over the waves and before the breaking of the undesired adhesions. Furthermore, the breaking of the undesired adhesions could in any event take place before the pressing flat of the waves.

It should therefore be understood that although the invention has been described with reference to a particular example, variations and modifications are possible within the inventive concept.

I claim:

1. A method of manufacturing a packing container, particularly for eggs, comprising the steps of:

(a) production of a first cardboard blank (2) to cut it longitudinally into five lengthwise running strips (3) which are held together at each end by an integral cross strip (4);

(b) production of a second cardboard blank (5) longer than said first cardboard blank (2) and having interrupted lengthwise slits (6) along four parallel lengthwise running lines and formation of transverse bending lines on said second cardboard blank (5) suitable for producing flat-topped transverse corrugations;

(c) forming waves (13) forming transverse corrugations of flat-topped wave form (13) out of said second cardboard blank (5) and adhesively sticking them onto said first cardboard blank (2) along each of the wave bottoms (9);

(d) bending over said waves (13) by tucking in the flat-top portions to form a flattened scale-like structure;

(e) separation of the adhesively-joined places along the boundaries of the already separated lengthwise strips (13) of said first cardboard blank (2), and (f) cutting off the two cross-strips (4) at the ends of said first cardboard blank (2).

2. A method as defined in claim 1, which also comprises the following subsequent steps:

(g) erecting said waves formed by said second cardboard blank;

(h) bending up side portions of the pack (20) with formation of upwardly open pockets (15), and (i) filling said pockets (15) with the objects to be packed (16), followed by bending over the upper pack portions (21) to form the top of the pack and securing the completely set up pack along the linear abutment (22) of the flat part of said upper pack portions.

* * * * *